US008706006B2

(12) United States Patent
Kim et al.

(10) Patent No.: US 8,706,006 B2
(45) Date of Patent: Apr. 22, 2014

(54) DEVELOPING DEVICE AND IMAGE FORMING APPARATUS INCLUDING THE SAME

(75) Inventors: Jong-in Kim, Suwon-si (KR); Sung-gi Kim, Seoul (KR); Dong-cheol Ahn, Yongin-si (KR); Sang-hoon Lee, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/478,216

(22) Filed: May 23, 2012

(65) Prior Publication Data

US 2013/0129385 A1 May 23, 2013

(30) Foreign Application Priority Data

Nov. 23, 2011 (KR) ..... 10-2011-0123174

(51) Int. Cl.
*G03G 21/18* (2006.01)

(52) U.S. Cl.
USPC ..... 399/115; 399/176

(58) Field of Classification Search
USPC ..... 399/50, 115, 176, 168
See application file for complete search history.

(56) References Cited

U.S. PATENT DOCUMENTS

| | | | | |
|---|---|---|---|---|
| 5,465,136 | A * | 11/1995 | Watanabe | 399/111 |
| 5,629,755 | A * | 5/1997 | Ohtsuka | 399/176 |
| 5,638,158 | A * | 6/1997 | Sanpe et al. | 399/174 |
| 5,666,608 | A * | 9/1997 | Christensen | 399/176 |
| 6,665,507 | B1 * | 12/2003 | Hooper et al. | 399/110 |
| 8,301,058 | B2 | 10/2012 | Kim | |
| 2006/0251447 | A1 | 11/2006 | Baek | |
| 2007/0098438 | A1 * | 5/2007 | Yamaguchi | 399/111 |
| 2007/0138732 | A1 * | 6/2007 | Hackney | 271/10.09 |
| 2011/0044722 | A1 * | 2/2011 | Agnissey et al. | 399/115 |
| 2011/0069989 | A1 | 3/2011 | Kim | |

FOREIGN PATENT DOCUMENTS

| | | | | |
|---|---|---|---|---|
| JP | 2001117467 | A * | 4/2001 | G03G 21/18 |
| KR | 10-2006-0116327 | | 11/2006 | |
| KR | 20060116327 | | 11/2006 | |
| KR | 10-2009-0053275 | | 5/2009 | |

(Continued)

OTHER PUBLICATIONS

Korean Office Action dated Feb. 18, 2013 issued in KR Application No. 10-2011-0123174.

(Continued)

*Primary Examiner* — David Gray
*Assistant Examiner* — Francis Gray
(74) *Attorney, Agent, or Firm* — Stanzione & Kim, LLP

(57) ABSTRACT

A developing device that attaches/detaches to/from a main body of an image forming apparatus includes a photosensitive drum, a charging roller to rotate while contacting the photosensitive drum to charge a surface of the photosensitive drum to a uniform potential, and a separating member to rotate between a first position where the charging roller is separated from the photosensitive drum and a second position where the charging roller contacts the photosensitive drum. The separating member includes a body into which a rotary shaft of the charging roller is inserted to be rotatable, and a contact portion extending from the body and contacting the surface of the photosensitive drum when the separating member is located at the first position so as to separate the charging roller from the photosensitive drum, wherein the contact portion includes a friction member including rubber.

22 Claims, 5 Drawing Sheets

(56) References Cited

FOREIGN PATENT DOCUMENTS

| | | |
|---|---|---|
| KR | 20090053275 | 5/2009 |
| KR | 10-2011-0030892 | 3/2011 |
| KR | 20110030892 | 3/2011 |

OTHER PUBLICATIONS

Korean Notice of Allowance dated Feb. 12, 2014 issued in KR Application No. 10-2011-0123174.

* cited by examiner

DEVELOPING DEVICE AND IMAGE FORMING APPARATUS INCLUDING THE SAME

CROSS-REFERENCE TO RELATED PATENT APPLICATION

This application claims the benefit of priority under 35 U.S.C. §119 from Korean Patent Application No. 10-2011-0123174, filed on Nov. 23, 2011, in the Korean Intellectual Property Office, the disclosure of which is incorporated herein in its entirety by reference.

BACKGROUND OF THE INVENTION

1. Field of the Invention

The present general inventive concept relates to a developing device including a charging roller that charges a photosensitive member and an electrophotographic image forming apparatus adopting the developing device.

2. Description of the Related Art

An electrophotographic image forming apparatus prints an image on a recording medium by forming an electrostatic latent image on a surface of a photosensitive member by irradiating a light beam that is modulated according to image information onto the photosensitive member, developing the electrostatic latent image into a visible toner image by supplying a toner onto the electrostatic latent image, and transferring the toner image onto the recording medium to fuse the toner image as the printed image. The electrophotographic image forming apparatus includes a developing device in which the toner is received.

The toner may be provided in a cartridge including a developing roller, and the cartridge may be referred to as a developing device. When the toner received in the developing device is completely consumed, the developing device is extracted from the electrophotographic image forming apparatus, and a new developing device is mounted in the electrophotographic image forming apparatus.

The developing device includes a charging roller for charging a photosensitive member. The charging roller contacts the photosensitive member. Before using the electrophotographic image forming apparatus or before mounting the developing device in the electrophotographic image forming apparatus, a contact state of the charging roller to the photosensitive member is maintained such that the charging roller is deformed. Also, a photosensitive layer of the photosensitive member may be damaged due to the deformation of the charging roller formed of a conductive rubber.

SUMMARY OF THE INVENTION

The present general inventive concept provides a developing device capable of selectively contacting/separating a photosensitive member and a charging roller, and an electrophotographic image forming apparatus adopting the developing device.

The present general inventive concept also provides a developing device capable of reducing a possibility for a charging roller to change from a separation position from a photosensitive member to a contact position to the photosensitive member due to a shock occurring during handling, and an electrophotographic image forming apparatus adopting the developing device.

The present general inventive concept also provides a developing device capable of easily changing a location of a charging roller from a separation position to a contact position due to a rotation of the photosensitive member, and an electrophotographic image forming apparatus adopting the developing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a developing device that is attachable/detachable to/from a main body of an image forming apparatus, the developing device including a photosensitive drum, a charging roller to rotate while contacting the photosensitive drum to charge a surface of the photosensitive drum to a uniform potential, and a separating member to rotate between a first position where the charging roller is separated from the photosensitive drum and a second position where the charging roller contacts the photosensitive drum. The separating member may include a body into which a rotary shaft of the charging roller is rotatably inserted, and a contact portion extending from the body and contacting the surface of the photosensitive drum when the separating member is located at the first position so as to separate the charging roller from the photosensitive drum, wherein the contact portion includes a friction member comprising rubber.

A surface of the friction member, which contacts the surface of the photosensitive drum, may be a concave surface.

The developing device may further include a shaft supporting member to support the rotary shaft of the charging roller, and an elastic member providing the shaft supporting member with a pressing force in a direction in which the charging roller contacts the photosensitive drum, wherein the separating member may be located inside the shaft supporting member so as not to escape in a direction of the rotary shaft of the charging roller due to the shaft supporting member.

The developing device may further include a stopper to restrict a contraction distance of the shaft supporting member in an opposite direction to the pressing force. The stopper may be separated from an end of the shaft supporting member in the opposite direction of the pressing force. A distance between the stopper and the end of the shaft supporting member may be equal to or less than a value about 0.5 mm greater than difference between a maximum radius and a minimum radius of the friction member based on a center of the rotary shaft of the charging roller.

The separating member may further include a lever extending from the body. A manipulation recess may be formed on a housing of the developing device such that an operator may access the lever through the manipulating recess to change the separating member to the first position or the second position. The lever may not protrude from the housing when the separating member is located at the first position or the second position.

The foregoing and/or other features and utilities of the present general inventive concept may also be achieved by providing a developing device that is attachable/detachable to/from a main body of an image forming apparatus, the developing device including a photosensitive drum, a charging roller to rotate while contacting the photosensitive drum to charge a surface of the photosensitive drum to a uniform potential, and a separating member to rotate between a first position where the charging roller is separated from the photosensitive drum and a second position where the charging roller contacts the photosensitive drum. The separating member may include a body into which a rotary shaft of the charging roller is inserted to be rotatable, a contact portion extending from the body and contacting the surface of the photosensitive drum when the separating member is located at the first position so as to separate the charging roller from the photosensitive drum, and a lever extending from the body. A manipulation recess may be formed on a housing of the developing device such that an operator may access the lever through the manipulating recess to change the separating member to the first position or the second position.

The lever may not protrude from the housing when the separating member is located at the first position or the second position.

The foregoing and/or other features and utilities of the present general inventive concept may also be achieved by providing a developing device that is attachable/detachable to/from a main body of an image forming apparatus, the developing device including a photosensitive drum, a charging roller to rotate while contacting the photosensitive drum to charge a surface of the photosensitive drum to a uniform potential, and a separating member to rotate between a first position where the charging roller is separated from the photosensitive drum and a second position where the charging roller contacts the photosensitive drum. The separating member may include a body into which a rotary shaft of the charging roller is inserted to be rotatable, and a contact portion extending from the body and contacting the surface of the photosensitive drum when the separating member is located at the first position so as to separate the charging roller from the photosensitive drum. The contact portion may include a friction member, and a surface of the friction member, which contacts the surface of the photosensitive drum, may be a concave surface.

The foregoing and/or other features and utilities of the present general inventive concept may also be achieved by providing an electrophotographic image forming apparatus including the developing device described above.

The foregoing and/or other features and utilities of the present general inventive concept may also be achieved by providing a developing device usable with an image forming apparatus, the developing device including a photosensitive drum, a charging roller to move between a non-contact position and a contact position with the photosensitive drum, and a separating member having a friction portion to contact the photosensitive drum when the charging roller is in the non-contact position.

The separating member may be disposed in a first position where the friction member contacts the photosensitive drum in the non-contact position of the charging roller.

The separating member may be disposed in a second position where the friction member is separated from the photosensitive drum in the contact position of the charging roller.

The charging roller may move in a radial direction of a center thereof between the non-contact position and the contact position. The separating member may rotate in a circumference direction of the center between a first position to contact the photosensitive drum in the non-contact position of the charging roller and a second position to be separated from the photosensitive drum in the contact position of the charging roller.

The friction portion may have a surface to correspond to a surface of the photosensitive drum.

The friction portion may have a thickness to correspond to a linear movement of the charging roller between the non-contact position and the contact position.

BRIEF DESCRIPTION OF THE DRAWINGS

The above and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
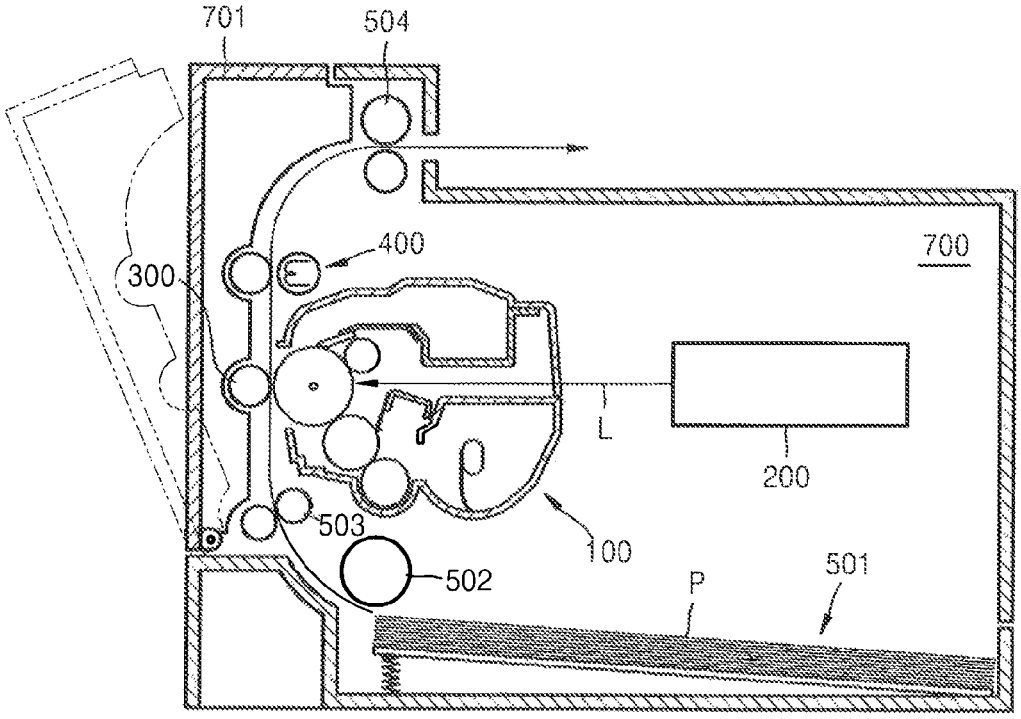
FIG. 1 is a diagram illustrating an image forming apparatus according to an embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
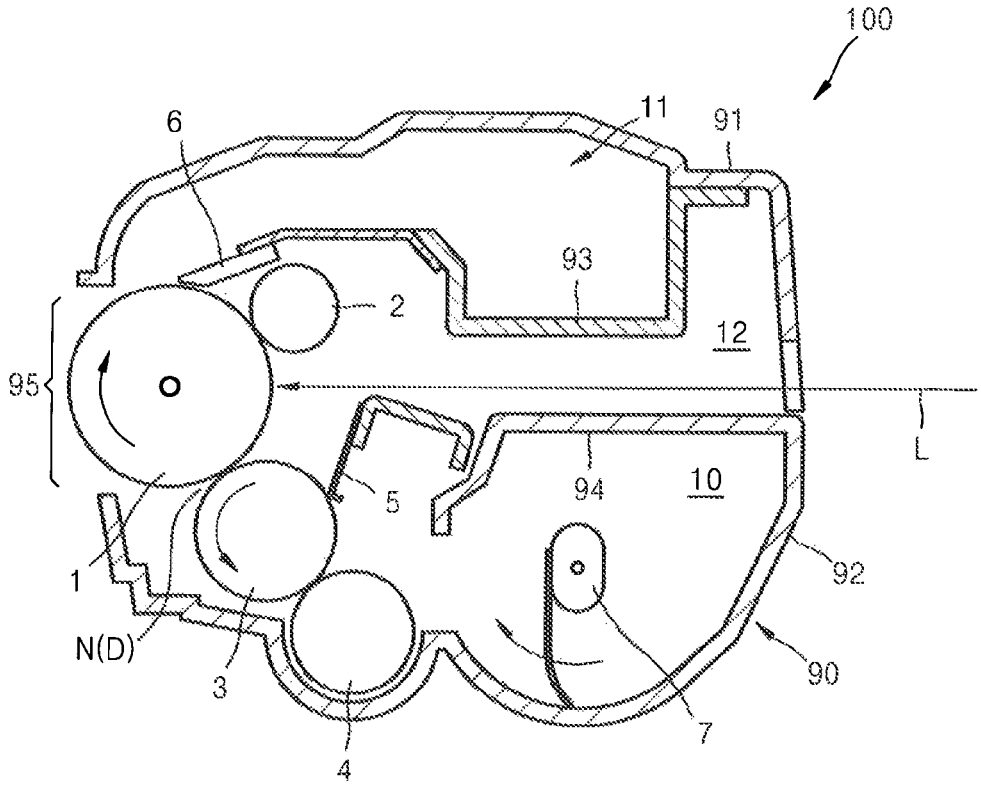
FIG. 2 is a diagram illustrating a developing device usable in the image forming apparatus of FIG. 1 according to an embodiment of the present inventive concept.

FIG. 1 is a block diagram illustrating an image forming apparatus according to an embodiment of the present inventive concept and FIG. 2 is a block diagram illustrating a developing device 100 usable in the image forming apparatus of FIG. 1, according to an embodiment of the present inventive concept.

Referring to FIG. 1, the developing device 100 is mounted in a main body 700 of the image forming apparatus via a door 701. When the developing device 100 is mounted in the main body 700, a driving unit (not shown) disposed in the main body 700 is connected to the developing device 100 to rotate components of the developing device 100. The developing device may include a photosensitive drum, a charging roller, a developing roller, a supplying roller, and an agitator.

An exposure unit 200 irradiates the light L that is modulated according to image information onto a surface of the photosensitive drum 1, which is charged to a uniform potential. A laser scanning unit (LSU) that deflects the light irradiated from a laser diode by using a polygon mirror in a main scanning direction and irradiates the deflected light onto the photosensitive drum 1 may be used as the exposure unit 200

A transferring roller 300 is an example of a transfer unit that is disposed to face the surface of the photosensitive drum 1 to form a transfer nip. A transferring bias voltage is applied to the transferring roller 300 to transfer a toner image developed on the surface of the photosensitive drum 1 onto a recording medium P picked up by a pickup roller 502 and conveyed by a conveying roller 503 from a loading unit 501. A corona transferring unit may be used instead of the transferring roller 300.

The toner image transferred on a surface of the recording medium P by the transferring roller 300 is maintained on the surface of the recording medium P due to an electrostatic attractive force. A fuser 400 fuses the toner image on the recording medium P by applying heat and pressure onto the toner image to form a permanent print image. The printed recording medium may be discharged by a discharge roller unit 504 to an outside of the image forming apparatus.

Referring to FIG. 2, the developing device 100 of the present embodiment includes a photosensitive drum 1 and a developing roller 3. The photosensitive drum 1 is an example of a photosensitive member on which an electrostatic latent image is formed and is fabricated by forming a photosensitive layer having a photoconductivity on an outer circumference of a cylindrical metal pipe. A charging roller 2 is an example of a charger that charges a surface of the photosensitive drum 1 to a uniform electric potential. A charging bias voltage is applied to the charging roller 2. A corona charger (not illustrated) may be used as a charger to charge the photosensitive drum 1, instead of the charging roller 2. The developing roller 3 develops the electrostatic latent image formed on the surface of the photosensitive drum 1 by supplying a toner to the electrostatic latent image. When a developing bias voltage is applied to the developing roller 3, the toner is transferred from a surface of the developing roller 3 onto the electrostatic latent image formed on the surface of the photosensitive drum 1 and attached.

The developing device 100 may further include a supplying roller 4 to attach the toner to the developing roller 3. A supplying bias voltage may be applied to the supplying roller 4 to attach the toner to the developing roller 3. A regulation member 5 regulates an amount of the toner attached to the surface of the developing roller 3. The regulation member 5 may be, for example, a regulation blade. A leading edge of the regulating blade may contact the developing roller 3 having the attached toner with a predetermined pressure. A cleaning member 6 removes remaining toner or impurities from the surface of the photosensitive drum 1 before the charging. The cleaning member 6 may be, for example, a cleaning blade. A leading edge of the cleaning blade may contact the surface of the photosensitive drum 1. Hereinafter, the impurities removed from the surface of the photosensitive drum 1 are referred to as waste toner.

The developing device 100 includes a toner receiving unit 10 and a waste toner receiving unit 11. The waste toner receiving unit 11 receives the waste toner that is removed from the surface of the photosensitive drum 1. The toner receiving unit 10 receives the toner. An agitator 7 is installed in the toner receiving unit 10. The agitator 7 transfers the toner to the developing roller 3. The agitator 7 may also charge the toner to a predetermined potential by agitating the toner. Although FIG. 2 illustrates one agitator 7, the present inventive concept is not limited thereto. An appropriate number of agitators 7 may be installed on appropriate locations in the toner receiving unit 10 in order to supply the toner effectively to the developing roller 3. The number of agitators may be determined according to a volume or a shape of the toner receiving unit 10. The agitator 7 may be formed by disposing one or more flexible film type agitating wings on a rotary shaft thereof. Although not illustrated in FIGS. 1 and 2, the agitator 7 may be an auger including a spiral agitating wing. The agitator 7 conveys the toner from the toner receiving unit 10 to the developing roller 3. The agitator 7 may simultaneously transfer and agitate the toner to frictionally charge the toner.

A housing 90 forms the toner receiving unit 10 and the waste toner receiving unit 11 and functions as a frame for supporting components of the developing device 100, such as the photosensitive drum 1, the charging roller 2, the developing roller 3, the supplying roller 4, and the agitator 7. A portion of an outer circumference of the photosensitive drum 1 is exposed from the housing 90 through an opening 95.

The housing 90 may include a first frame 91 and a second frame 92. The first frame 91 may have a structure to support the photosensitive drum 1, the charging roller 2, and the cleaning member 6. The first frame 91 may also have a structure as the waste toner receiving unit 11. The second frame 92 may have a structure to support the developing roller 3, the supplying roller 4, the regulation member 5, and the agitator 7. The second frame 92 may have a structure as the toner receiving unit 10. A lower wall 93 of the first frame 91 and an upper wall 94 of the second frame 92 are separated from each other to provide an optical path 12. Light L irradiated from an exposure unit (200 of FIG. 1) is incident through the optical path 12 to expose the photosensitive drum 1. The optical path 12 is formed between the lower wall 93 and the upper wall 94. When the first frame 91 and the second frame 92 are combined or coupled to form the housing 90, the housing may have an opening or slit formed on at least one of the first frame 91 and the second frame 92 as an inlet of the optical path 12 of the housing 90 to receive the light L. The optical path 12 may be disposed between the charging roller 2 and the developing roller 3 such that the light L passes through a space provided between the lower wall 93 and the upper wall 94 and also through a space provided between the charging roller 2 and the developing roller 3.

A printing process of forming an image in an image forming apparatus having the above-described structure will be described with reference to FIGS. 1 and 2. A charging bias voltage is applied to the charging roller 2, and the photosensitive drum 1 is charged to a uniform potential. The exposure unit 200 irradiates the light L that is modulated according to image information onto the photosensitive drum 1 through the optical path 12 in the developing device 100, and thus an electrostatic latent image is formed on a surface of the photosensitive drum 1. The toner is conveyed toward the supplying roller 4 by the agitator 7, and the supplying roller 4 attaches the toner to a surface of the developing roller 3. The regulation member 5 forms a toner layer on the surface of the developing roller 3 to a uniform thickness. A developing bias voltage is applied to the developing roller 3. The toner conveyed to a developing nip N or a developing gap D according to the rotation of the developing roller 3 is attached onto the electrostatic latent image formed on the surface of the photosensitive drum 1 by the developing bias voltage to form a visible toner image on the surface of the photosensitive drum 1. The recording medium P picked up from the loading unit 501 by the pickup roller 502 is conveyed by the conveying roller 503 to a transferring nip where the transferring roller 300 and the photosensitive drum 1 face each other. When a transferring bias voltage is applied to the transferring roller 300, the toner image is transferred on the recording medium P by an electrostatic attractive force. When the toner image transferred on the recording medium P is fused on the recording medium P due to heat and pressure applied from the fuser 400, the printing process may be finished. The recording medium P is discharged by a discharging roller 504. The toner remaining on the surface of the photosensitive drum 1 is removed by the cleaning member 6 and received by the waste toner receiving unit 11.

Figure 3:
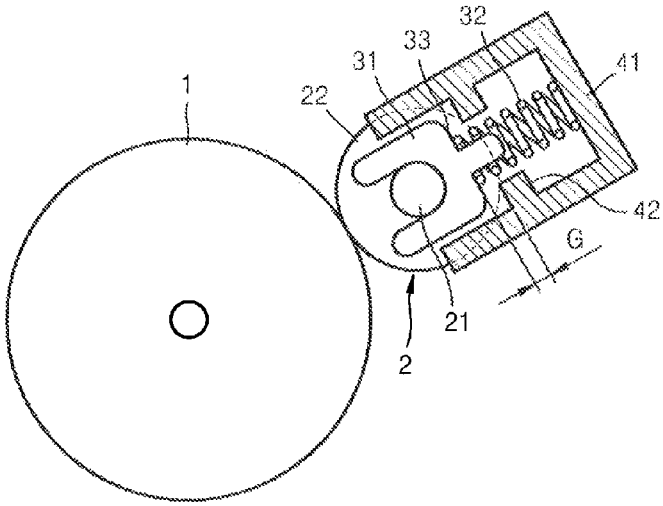
FIG. 3 is a cross-sectional view illustrating a relationship between a charging roller and a photosensitive drum of the developing device of FIG. 2.
Figure 4:
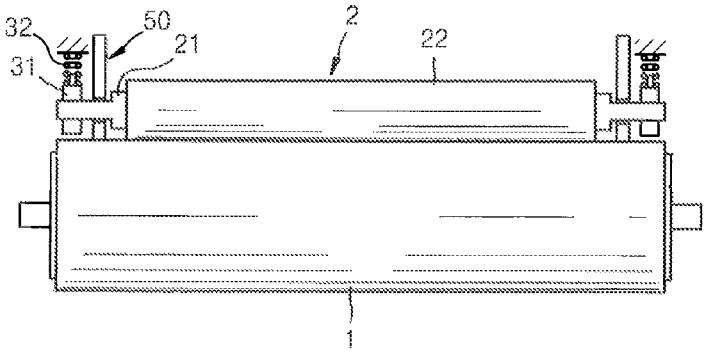
FIG. 4 is a front view illustrating a relationship between a charging roller and a photosensitive drum of the developing device of FIG. 2.

The charging roller 2 rotates while contacting the photosensitive drum 1. Referring to FIGS. 3 and 4, the charging roller 2 may include a rotary shaft 21 formed of, for example, metal, and a conductive rubber layer 22 disposed on an outer circumference of the rotary shaft 21. A charging bias voltage to charge the photosensitive drum 1 may be applied to the charging roller 2 via the rotary shaft 21. A shaft supporting member 31 is coupled to opposite end portions of the rotary shaft 21. The shaft supporting member 31 may be a mold bearing or a sintered bearing including oil. An elastic member 32 applies an elastic force to the shaft supporting member 31 in a direction in which the charging roller 2 contacts the photosensitive drum 1. For example, the elastic member 32 may be a compression coil spring, opposite ends of which are supported respectively by the housing 90 and the shaft supporting member 31. Although FIG. 3 illustrates the supporter 41, the supporter 41 may be a portion of the housing 90. The elastic member 32 may be directly connected to the housing 90 to support the shaft supporting member and the charging roller 2 with respect to the photosensitive drum 1.

The shaft supporting member 31 may be guided by a supporter 41 disposed on the housing 90. When the shaft supporting member 31 is guided by the supporter 41 and slides toward the photosensitive drum 1 due to the elastic force of the elastic member 32, the charging roller 2 contacts the photosensitive drum 1.

The developing device 100 is expendable, and thus, may be separately packaged from the image forming apparatus in a separate box or may be packaged together with the image forming apparatus in a same packing box. Here, when the charging roller 2 and the photosensitive drum 1 contact each other, the charging roller 2 may deform due to the pressing force of the elastic member 32. In addition, the conductive rubber layer 22 of the charging roller 2 may be deformed, thus damaging a photosensitive layer of the surface of the photosensitive drum 1. As described above, if the photosensitive layer is damaged, printing defects, such as transverse lines on a printed image, may occur and printing quality may be lowered.

Figure 5:
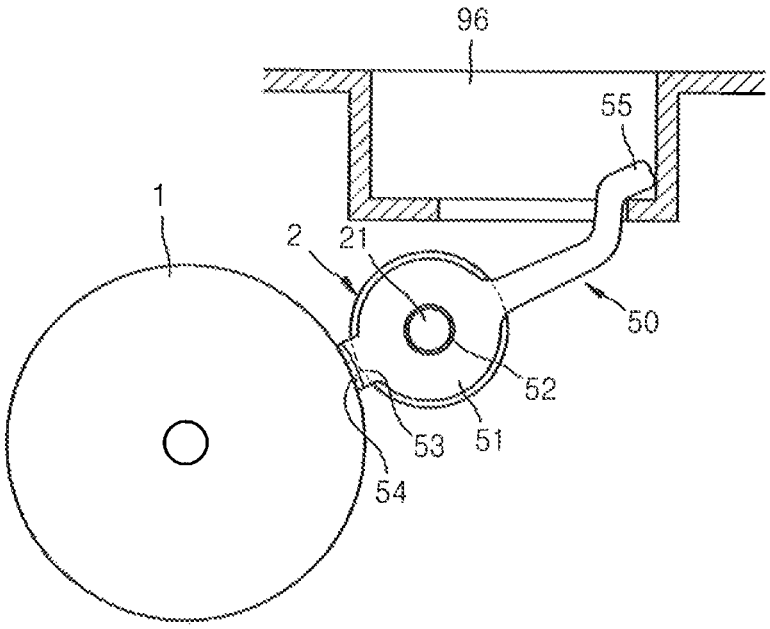
FIG. 5 is a cross-sectional view illustrating a state where a separating member is located at a first position where the charging roller is separated from the photosensitive drum in the developing device of FIG. 2.

The charging roller 2 may be separate from the photosensitive drum 1 before a printing process is performed or before the image forming apparatus is turned on or ready to perform the printing process. Referring to FIGS. 4 and 5, a separating member 50 is illustrated to isolate the charging roller 2 and the photosensitive drum 1 from each other. The separating member 50 includes a body 51 having a through hole 52 in which the rotary shaft 21 of the charging roller 2 is inserted to be rotatable, and a contact portion 53 extending from the body 51. The contact portion 53 may include a friction member 54. The friction member 54 may be rubber, for example. The body 51 may be formed of plastic, and the friction member 54 may be attached to the body 51. The rotary shaft 21 is inserted into the through hole 52. It is possible that the rotary shaft 21 is rotatable with respect to the through hole 52. It is possible that the rotary shaft 21 and the body 51 are independently rotatable. The charging roller 2 may be rotatable independent of the rotary shaft 21. It is also possible that the separating member 50 is independently rotatable with respect to the rotary shaft 21. The rotary shaft 21 may have a groove or protrusion to support the body 52 through the through hole 52. A diameter of the though hole 52 may be larger than that of the rotary shaft 21. In this case, it is possible that the rotary shaft 21 has a structure to position the body 51. It is also possible that the body 51 may be supported by a portion of the housing 90. It is possible that a diameter of the though hole 52 may be smaller than that of the rotary shaft 21 such that the through hole 52 is received in a recess portion of the rotary shaft 21.

As illustrated in FIG. 4, the rotating shaft 21 may be inserted in the separating member 50 such that the separating member 50 may be disposed inside the shaft supporting member 31. According to the above structure, the separating member 50 does not escape in a direction of the rotary shaft 21. That is, the shaft supporting member 31 may function as a stopper to prevent the separating member 50 from escaping from the rotary shaft 21. The rotary shaft 21 may have a first portion to correspond to the conductive rubber layer 22 of the charging roller 2, a second portion to correspond to the separating member 50, and a third portion to correspond to the shaft supporting member 31. The rotary shaft 21 may also have a fourth portion to receive the charging bias voltage from a power source unit (not illustrated) of the image forming apparatus. The power source unit may supply voltages to other components of the image forming apparatus.

As illustrated in FIG. 5, when the separating member 50 is located at a first position where a friction member 54 contacts the surface of the photosensitive drum 1, the elastic member 32 is compressed such that the charging roller 2 is separate from the surface of the photosensitive drum 1. When the developing device 100 is installed in the main body 700 of the image forming apparatus and the photosensitive drum 1 rotates to form an image in a printing process, the separating member 50 is rotated with respect to the rotary shaft 21 of the charging roller 2 to change from the first position to a second position. The separating member 50 may move from the first position to the second position due to a frictional force between the friction member 54 and the surface of the photosensitive drum 1. When the friction member 54 and the photosensitive drum 1 is not in a contact portion, for example, in the second position, the charging roller 2 is pushed by the elastic force of the elastic member 32 to contact the photosensitive drum 1.

When the developing device 100 is packaged and distributed, shock may be applied to the developing device 100. Due to the shock, the separating member 50 is changed to the second position, thereby causing the charging roller 2 to contact the photosensitive drum 1. According to the developing device 100 of the present embodiment, the friction member 54 formed of rubber is disposed on a contact portion 53 that faces the photosensitive drum 1 when the separating member 50 is located at the first position. The frictional force of the rubber of the friction member 54 is greater than that of a material, for example, plastic, of the separating member 50. Therefore, when there is a shock applied to the developing device 100, the separating member 50 may not be easily changed to the second position.

When the separating member 50 is not moved to the second position due to the shock applied to the developing device 100, the separating member 50 may apply shock to the photosensitive drum 1 when the elastic member 32 returns to an original state after the compression, and the friction member 54 may function as a buffer that may reduce the shock applied to the photosensitive drum 1 due to the elasticity. Accordingly, damage to the photosensitive layer of the surface of the photosensitive drum 1 may be reduced.

Since the friction member 54 formed of rubber has a large frictional force, the friction member 54 may rotate with the photosensitive drum 1 when the photosensitive drum 1 rotates in a state where the friction member 54 contacts the surface of the photosensitive drum 1. Therefore, the friction member 54 formed of rubber may cause the separating member 50 to change to the second position when the developing device 100 is installed in the main body 700 of the image forming apparatus and the photosensitive drum 1 rotates. The friction member 54 may have a material softer than that of the photosensitive drum 1 and/or the charging roller 2. It is possible that the friction member 54 may have a material having a material having a friction greater than that of the photosensitive drum 1 and/or the charging roller 2.

In order to increase a contact area to the surface of the photosensitive drum 1, the surface of the friction member 54 facing the surface of the photosensitive drum 1 may be formed as a concave surface, and may be a curved surface having the same radius of curvature as that of the surface of the photosensitive drum 1.

Figure 7:
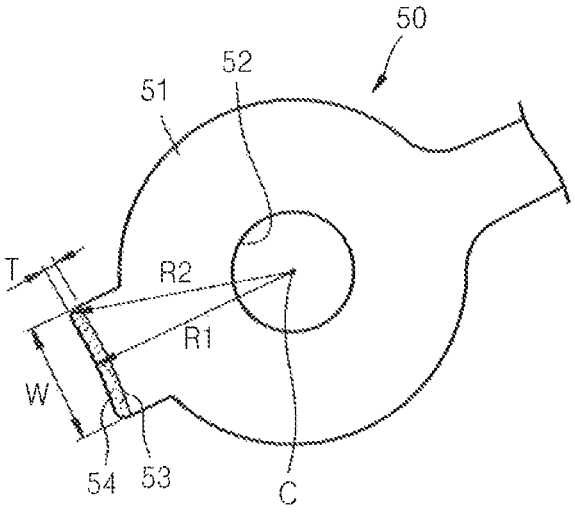
FIG. 7 is a diagram illustrating a contact portion of a separating member in the developing device of FIG. 2.

In order to reduce the possibility of changing the position of the separating member 50 into the second position due to the shock applied to the developing device 100, a moving distance of the charging roller 2 between the first position and the second position of the separating member 50 may be determined according to a force to be exerted on the separating member 50 to cause a change of the position. It is possible that a contraction distance of the elastic member 32 of the shaft supporting member 31 in an opposite direction to the pressing force may be limited to a predetermined distance. For example, referring to FIG. 3, a stopper 42 may be formed on the housing 90. The stopper may be formed on the supporter 41. The stopper 42 is disposed at a predetermined distance apart from an end portion 33 of the shaft supporting member 31 in the opposite direction to the pressing force. A distance G between the end portion 33 of the shaft supporting member 31 and the stopper 42 may be determined appropriately so that the separating member 50 is not changed to the second position due to the shock and the separating member 50 may be changed to the second position according to a rotation of the photosensitive drum 1. The friction force between the photosensitive drum 1 and the separating member 50 may be determined according to a force generated from a rotation of the photosensitive drum 1 such that the separating member 50 moves from the first position to the second position. When the distance G is too long, it may not be possible to prevent the separating member 50 from rotating due to the shock. When the distance G is too short, the separating member 50 may not be changed to the second position when the photosensitive drum 1 rotates. For example, referring to FIG. 7, the distance G may be equal to or less than a value about 0.5 mm greater than a difference between a maximum radius R2 and a minimum radius R1 of the friction member 54 with respect to a center C of the rotary shaft 21 of the charging roller 2.

Since the contact portion 53 has a curved surface and the friction member 54 is disposed on the contact portion 53, the maximum radius R2 may be a distance between at least one end portion of the friction member 54 and the center C of the rotary shaft 21, and the minimum radius R1 may be a distance between a middle portion of the friction member 54 and the center C of the rotary shaft 21. The minimum radius R1 is longer than a diameter of the charging roller.

A width W of the friction member 54 and a width of the contact member may be same. However, the present general inventive concept is not limited thereto. The width W of the friction member 54 may be longer than the width of the contact member. The width W of the friction member 54 may be determined to avoid any damage to the photosensitive drum 1 at a time of the separation.

A thickness T of the friction member 54 may be constant throughout the width. However, it is possible that the thickness T of the friction member 54 may be variable with respect to a surface of the contact portion 53. It is also possible that at least a portion of the friction member 54 may be thicker than other portions of the friction member 54. The friction member 54 may be gradually separated from the photosensitive drum 1 according to a rotation of the photosensitive drum 1. In this case, a last portion of the friction member 54, in which the friction member 54 is completely separated from the photosensitive drum 1, may have a thickness to avoid any damage to the photosensitive drum 1 at a time of the separation.

Figure 6:
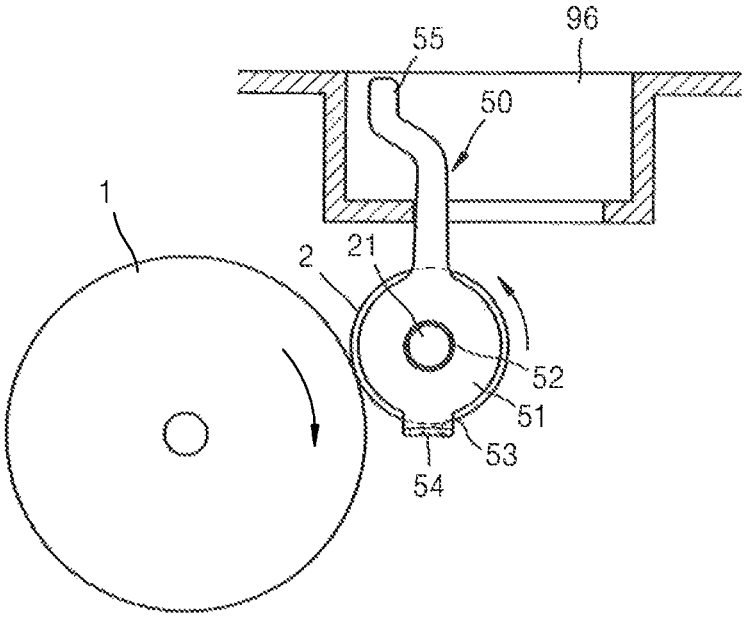
FIG. 6 is a cross-sectional view illustrating a state where a separating member is located at a second position where the charging roller contacts the photosensitive drum in the developing device of FIG. 2.

Referring to FIGS. 5 and 6, a lever 55 extending from the body 51 may be formed on the separating member 50. The lever 55 may be disposed opposite to the contact portion 53 with respect to the center C of the rotary shaft 21. It is possible that the level 55 may have an angle with a line connecting the center C of the rotary shaft 21 and the contact portion 53. The lever 55 is usable to manually change the separating member 50 between the first position and the second position. A fabrication process of the developing device 100 may include a process of testing whether there is any defect in the developing device 100. During the test process, the charging roller 2 needs to contact the photosensitive drum 1. To do this, the housing 90 may include a manipulation recess 96 that is opened to access the lever 55. The manipulation recess 96 may be recessed inward from an upper wall of the first frame 91. The lever 55 is located in the manipulation recess 96. An operator may manipulate the lever 55 to change the separating member 50 from the first position to the second position in order to perform the test process. When the photosensitive drum 1 is rotated to perform the test, the separating member 50 is changed to the second position, and thus, there is no need to change the position of the separating member 50 manually to the second position. When the test process is finished, the charging roller 2 is switched to the first position before packaging. Here, the operator may change the separating member 50 to the first position by operating the lever 55 via the manipulation recess 96. As described above, since the lever 55 and the manipulation recess 96, through which the operator may access the lever 55, are formed, there is no need to disassemble a part of the developing device 100 in order to separate the charging roller 2 from the photosensitive drum 1 after the test process, and thus, productivity may be improved.

When the waste toner receiving unit 11 has a width narrower than a width of the housing 90 in a direction parallel to a rotation axis of the rotary shaft 21, the lower wall 93 may have a structure to be formed with the manipulation recess 96. In this case, the manipulation recess 96 may be formed on a portion of the lower wall 93 which is exposed to an outside thereof. In this case, it is also possible that the manipulation recess 96 may be a groove or a portion of a side of the lower wall 93.

In order not to change the separating member 50 unintentionally during the production process or the packaging process, the lever 55 of the separating member 50 is formed to not protrude out of the housing 90 in a state where the separating member 50 is located at the first position or the second position. That is, the lever 55 is formed to be located in the manipulation recess 96.

In the above embodiment, a single-color image forming apparatus including one developing device 100 is described; however, the present inventive concept is not limited thereto. In a full-color image forming apparatus, four developing devices including toners of cyan (C), magenta (M), yellow (Y), and black (K) colors may be used.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device usable with a main body of an image forming apparatus, the developing device comprising:

a photosensitive drum;

a charging roller to rotate while contacting the photosensitive drum to charge a surface of the photosensitive drum to a uniform potential; and a separating member to rotate between a first position where the charging roller is separated from the photosensitive drum and a second position where the charging roller contacts the photosensitive drum, the separating member comprising:

a body into which a rotary shaft of the charging roller is rotatably inserted; and a contact portion extending from the body and contacting the surface of the photosensitive drum when the separating member is located at the first position so as to separate the charging roller from the photosensitive drum, the contact portion including a friction member formed of rubber;

a shaft supporting member to support the rotary shaft of the charging roller;

an elastic member providing the shaft supporting member with a pressing force in a direction in which the charging roller contacts the photosensitive drum; and a stopper to restrict a contraction distance of the shaft supporting member in an opposite direction to the pressing force.

2. The developing device of claim 1, wherein a surface of the friction member is a concave surface to contact the surface of the photosensitive drum.

3. The developing device of claim 2, wherein the separating member is located inside the shaft supporting member so as not to escape in a direction of the rotary shaft of the charging roller due to the shaft supporting member.

4. The developing device of claim 1, wherein the stopper is separated from an end of the shaft supporting member in the opposite direction of the pressing force.

5. The developing device of claim 4, wherein a distance between the stopper and the end of the shaft supporting member is equal to or less than a value about 0.5 mm greater than difference between a maximum radius and a minimum radius of the friction member with respect to a center of the rotary shaft of the charging roller.

6. The developing device of claim 1, wherein the separating member comprises a lever extending from the body, and wherein a manipulation recess is formed on a housing of the developing device such that an operator may access the lever through the manipulating recess to change the separating member to the first position or the second position.

7. The developing device of claim 6, wherein the lever does not protrude from the housing when the separating member is located at the first position or the second position.

8. An electrophotographic image forming apparatus to print an image on a recording medium and comprising the developing device of claim 1.

9. The electrophotographic image forming apparatus of claim 8, wherein a surface of a friction member, which contacts the surface of the photosensitive drum, is a concave surface.

10. The electrophotographic image forming apparatus of claim 8, wherein the separating member is located inside the shaft supporting member so as not to escape in a direction of the rotary shaft of the charging roller due to the shaft supporting member.

11. The electrophotographic image forming apparatus of claim 8, wherein the stopper is separated from an end of the shaft supporting member in the opposite direction of the pressing force.

12. The electrophotographic image forming apparatus of claim 11, wherein a distance between the stopper and the end of the shaft supporting member is equal to or less than a value about 0.5 mm greater than a difference between a maximum radius and a minimum radius of the friction member with respect to a center of the rotary shaft of the charging roller.

13. The electrophotographic image forming apparatus of claim 8, wherein the separating member comprises a lever extending from the body, and wherein a manipulation recess is formed on a housing of the developing device such that an operator may access the lever through the manipulating recess to change the separating member to the first position or the second position.

14. The electrophotographic image forming apparatus of claim 13, wherein the lever does not protrude from the housing when the separating member is located at the first position or the second position.

15. A developing device usable with a main body of an image forming apparatus, the developing device comprising:

a photosensitive drum;

a charging roller to rotate while contacting the photosensitive drum to charge a surface of the photosensitive drum to a uniform potential; and a separating member to rotate between a first position where the charging roller is separated from the photosensitive drum and a second position where the charging roller contacts the photosensitive drum, the separating member comprising:

a body into which a rotary shaft of the charging roller is inserted to be rotatable;

a contact portion extending from the body and contacting the surface of the photosensitive drum when the separating member is located at the first position so as to separate the charging roller from the photosensitive drum; and a lever extending from the body, and wherein a manipulation recess is formed on a housing of the developing device such that an operator may access the lever through the manipulating recess to change the separating member to the first position and the second position.

16. The developing device of claim 15, wherein the lever does not protrude from the housing when the separating member is located at the first position or the second position.

17. A developing device usable with a main body of an image forming apparatus, the developing device comprising:

a photosensitive drum;

a charging roller to rotate while contacting the photosensitive drum to charge a surface of the photosensitive drum to a uniform potential; and a separating member to rotate between a first position where the charging roller is separated from the photosensitive drum and a second position where the charging roller contacts the photosensitive drum, the separating member comprising:

a body into which a rotary shaft of the charging roller is inserted to be rotatable; and a contact portion extending from the body and contacting the surface of the photosensitive drum when the separating member is located at the first position so as to separate the charging roller from the photosensitive drum, the contact portion including a friction member, the friction member having a concave surface to contact and conform to the surface of the photosensitive drum.

18. A developing device usable with an image forming apparatus, the developing device comprising:

a photosensitive drum;

a charging roller to move between a non-contact position and a contact position with the photosensitive drum; and a separating member having a concave-shaped friction portion to contact and conform to a surface of the photosensitive drum when the charging roller is in the non-contact position.

19. The developing device of claim 18, wherein the separating member is disposed in a first position where the friction member contacts the photosensitive drum in the non-contact position of the charging roller.

20. The developing device of claim 19, wherein the separating member is disposed in a second position where the friction member is separated from the photosensitive drum in the contact position of the charging roller.

21. The developing device of claim 18, wherein:

the charging roller moves in a radial direction of a center thereof between the non-contact position and the contact position; and the separating member rotates in a circumference direction of the center between a first position to contact the photosensitive drum in the non-contact position of the charging roller and a second position to be separated from the photosensitive drum in the contact position of the charging roller.

22. The developing device of claim 18, wherein:

the friction portion has a thickness to correspond to a linear movement of the charging roller between the non-contact position and the contact position.

* * * * *